US006199212B1

(12) United States Patent
Hambleton

(10) Patent No.: US 6,199,212 B1
(45) Date of Patent: Mar. 13, 2001

(54) CAMOUFLAGE DEVICE FOR DISGUISING A HUMAN SILHOUETTE

(76) Inventor: John D. Hambleton, 2462 160th Rd., Guthrie Center, IA (US) 50115

( * ) Notice: Subject to any disclaimer, the term of this patent is extended or adjusted under 35 U.S.C. 154(b) by 0 days.

(21) Appl. No.: 09/631,324

(22) Filed: Aug. 3, 2000

(51) Int. Cl.[7] ..... A42B 19/02
(52) U.S. Cl. ..... 2/171; 2/900; 43/1
(58) Field of Search ..... 2/171, 206, 207, 2/209.11, 209.13, 49.1, 900; 43/1, 2; 135/901

(56) References Cited

U.S. PATENT DOCUMENTS

| | | | | |
|---|---|---|---|---|
| 3,823,418 | | 7/1974 | Piper . | |
| 4,106,124 | * | 8/1978 | Green | 2/187 |
| 4,285,068 | | 8/1981 | Ross . | |
| 5,025,507 | | 6/1991 | Kirby . | |
| 5,062,234 | * | 11/1991 | Green | 42/1 |
| 5,091,996 | | 3/1992 | Kirby . | |
| 5,197,216 | | 3/1993 | Norris . | |
| 5,572,823 | | 11/1996 | Savaria . | |
| 5,652,963 | | 8/1997 | Davison . | |
| 6,021,794 | * | 2/2000 | Guerra | 135/95 |
| 6,061,828 | * | 5/2000 | Josephs | 2/69 |

* cited by examiner

*Primary Examiner*—John J. Calvert
*Assistant Examiner*—Katherine Moran
(74) *Attorney, Agent, or Firm*—Henderson & Sturm LLP

(57) ABSTRACT

A camouflage device (10) for disguising the silhouette of a hunter's head and shoulders wherein the device includes: an elongated support bar member (20) having outer ends (21), (22) which towards the ends of a hunter's shoulders wherein the support bar member (20) is adapted to be supported by the hunter's head; and, a camouflage panel unit (30) including a pair of panel segments (34), (35) suspended from the support bar member (20) and defining an enlarged opening (32) that is dimensioned to surround the hunter's head in the same general vertical plane.

20 Claims, 1 Drawing Sheet

CAMOUFLAGE DEVICE FOR DISGUISING A HUMAN SILHOUETTE

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

This invention relates generally to the field of camouflage headgear in general and in particular to a device that is specifically designed to eliminate the normal silhouette of a hunter's head.

2. Description of the Related Art

As can be seen by reference to the following U.S. Pat. Nos. 3,823,418; 85,068; 5,025,507; 5,091,996; and 5,197,216, the prior art is replete with myriad and diverse examples of camouflage headgear designed to cover and conceal a hunter's head and facial features.

While all of the aforementioned prior art constructions are more than adequate for the basic purpose and function for which they have been specifically designed, they are uniformly deficient with respect to their failure to provide a simple, efficient, and practical device for disguising the distinctive silhouette of a hunter's head.

As most hunters are aware, the human silhouette is very distinctive to virtually all animals and the signature portion of the human anatomy that signifies danger to wild animals is the human head atop the human's shoulders. Unfortunately, for most hunters, it is also the sudden movement of their heads which is instantly recognized by game animals and causes the animals to flee or sneak away from the location of the hunter.

As a consequence of the foregoing situation, there has existed a longstanding need for a new and improved type of camouflage headgear that disguises the easily recognizable outline of the hunter's head so that even if a game animal detects the movement of the hunter's head, the animal will not immediately associate that movement with the presence of a human due to the fact that they will not be seeing the signature silhouette of a human head; and, the provision of such a construction is the stated objective of the present invention.

BRIEF SUMMARY OF THE INVENTION

Briefly stated, the camouflage device for disguising the silhouette of a hunter's head that forms the basis of the present invention comprises in general a support unit and a camouflaged panel unit that is suspended from the support unit.

As will be explained in greater detail further on in the specification, the camouflage panel unit is designed to extend on opposite sides of the hunter's head in the direction of the hunter's shoulders and to surround the hunter's head, and be deployed in the same general vertical plane relative to the hunter's head; such that the top of the panel unit extends in a generally straight line above the hunter's head to eliminate the signature silhouette thereof.

In addition, the support unit includes an elongated support bar member that rests on a top portion of the hunter's head wherein the camouflage panel unit is suspended from the support bar member.

Furthermore, the camouflage panel unit includes a sheet of camouflage material that is provided with an enlarged opening that defines two panel segments that encircle the hunter's head with the overall effect being that the signature silhouette of the hunter's head is replaced by the unfamiliar silhouette of the camouflage device.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
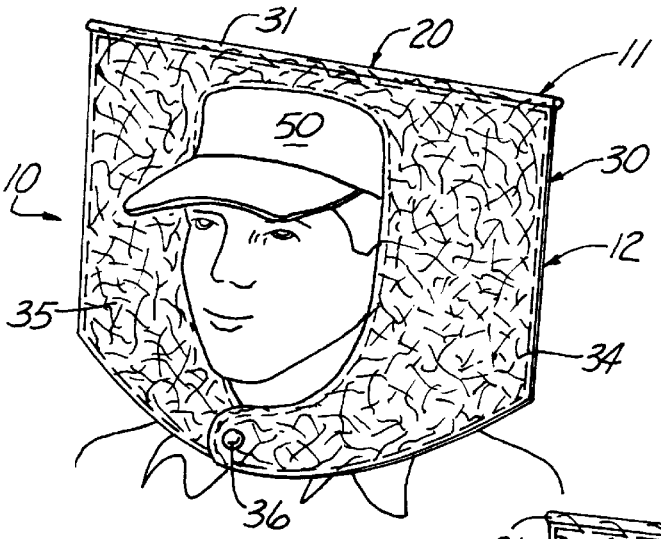
FIG. 1 is a front perspective view of the camouflage device being worn by a hunter.

As can be seen by reference to the drawings, and in particular to FIG. 1, the camouflage device that forms the basis of the present invention is designated generally by the reference number (10). The device (10) comprises in general a support unit (11) and a camouflage panel unit (12) that is suspended from the support unit (11). These units will now be described in seriatim fashion.

As shown in FIGS. 1 through 4, the support unit (11) comprises in general an elongated support rod member (20) that is adapted to be supported by the top of a hunter's head wherein the opposite ends (21), (22) of the support rod member (20) are dimensional to extend outwardly from the opposite sides of the hunter's head to a point generally aligned with ends of the hunter's shoulders.

Figure 2:
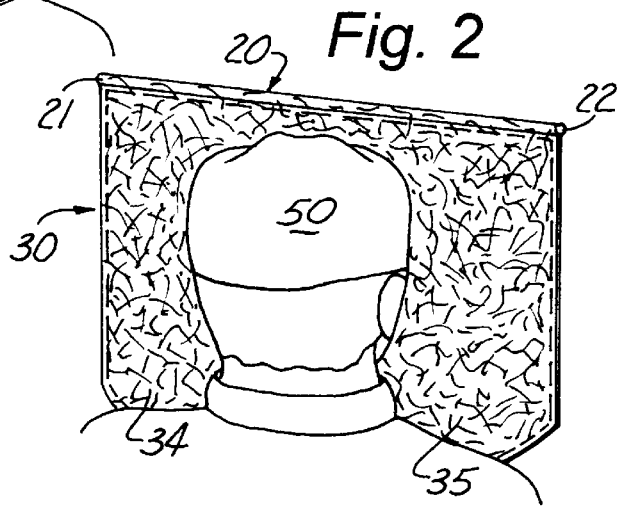
FIG. 2 is a rear perspective view of he camouflage device being worn by a hunter.
Figure 3:
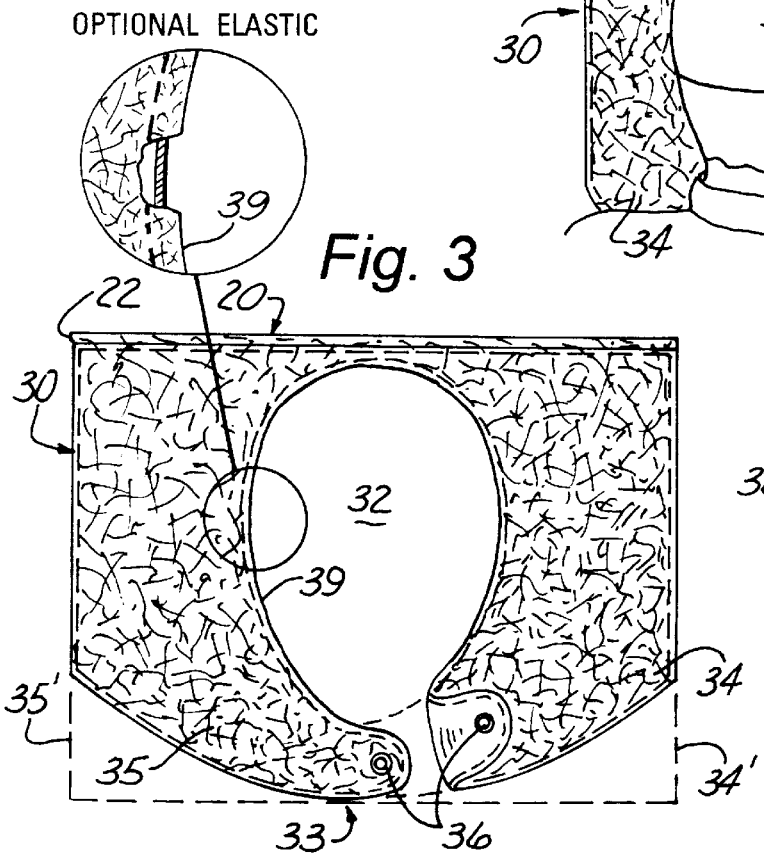
FIG. 3 is an isolated front elevation view of the camouflage device.

As can be seen by reference to FIGS. 1 through 3, the camouflage panel unit (12) comprises a sheet of camouflage material (30) having an upper end (31) operatively associated with the support rod member (20) wherein the central portion of the sheet of camouflage material is provided with an enlarged opening (32) that extends through the lower end of the sheet of camouflage material (30) to form two downwardly depending inwardly curved camouflage panel segments (34), (35) whose inboard ends are provided with cooperating fastening elements (36) which can be snaps or VELCRO, such that the panel segments (34), (35) can be joined together to encircle a hunter's head with or without the benefit of additional headgear (50).

It should also be noted at this juncture that this invention also contemplates the releasable attachment of the camouflage device (10) directly to conventional hunting headgear (50) by the use of any suitable cooperating fastening means (not shown) employed for that specific purpose.

In addition, as shown in FIG. 3, while the preferred embodiment of this invention illustrates the panel segments (34), (35) as having inwardly curved exterior edges, this invention also contemplates fabricating the panel unit (12) from a generally rectangular sheet of camouflage material; wherein, the outer edges of the panel segments (34), (35) will be squared off as depicted by the dashed lines (34') and (35').

Figure 4:
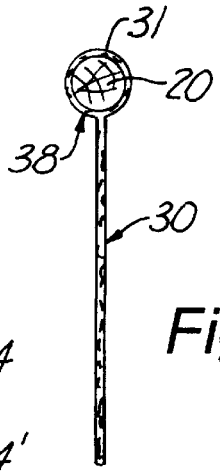
FIG. 4 is an isolated side elevation view of the camouflage device.

Furthermore, as shown in FIG. 4 while the preferred embodiment of the invention shows the upper end (31) of the sheet of camouflage material formed into a sleeve (38) that is dimensioned to slidably receive the support bar member (20); it is to be understood that the upper end (31) of the sheet of camouflage material (30) can be fixedly secured to the support rod member (20) by adapted, adhesives or other conventional permanent securing means.

Returning once more to FIG. 3, it can be seen that this invention also contemplates stitching (39) around the periphery of the central opening (32) and having the bottom edge (33) of the panel unit (12) which can be formed from a continuous sheet of material (30).

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures. Thus, although a nail and screw may not be structural equivalents in that a nail employs a cylindrical surface to secure wooded parts together, whereas, a screw employs a helical surface, in the environment of fastening wooden parts, a nail and a screw may be equivalent structures.

Having hereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A camouflage device for disguising the silhouette of a hunter's head and shoulders wherein the device comprises a support unit including an elongated support bar member adapted to be supported by the top of a hunter's head wherein the support bar member has opposite ends which extend outwardly a substantial distance from the opposite sides of the hunter's head; and a camouflage panel unit including two panel segments which depend downwardly from the support bar member on opposite sides of the hunter's head.

2. The device as in claim 1; wherein, said support bar member and said panel segments are adapted to encircle the hunter's head.

3. The device as in claim 1; wherein, said panel segments are fabricated from a sheet of camouflage material.

4. The device as in claim 1; wherein, said panel segments are fabricated from a sheet of camouflage material having an upper end operatively associated with said support bar member and whose lower end is provided with cooperating fastening elements for joining the panel segments together.

5. The device as in claim 1; wherein, said camouflage panel unit further comprises a sheet of camouflage material provided with an enlarged opening dimensioned to surround a hunter's head.

6. The device as in claim 5; wherein, the periphery of the enlarged opening is provided with a strip of elasticized material.

7. The device as in claim 1; wherein, each end of the support bar member extends outwardly to a point above each of the hunter's shoulders.

8. A camouflage device for disguising the silhouette of a hunter's head and shoulders wherein the device comprises a camouflage panel unit including a generally flat sheet of camouflage material provided with an enlarged central opening that is dimensioned to encircle a hunter's head in a generally vertical plane; wherein, the sheet of camouflage material has outer edges which extend towards the ends of the hunter's shoulders.

9. The device as in claim 8; wherein, the sheet of material is provided with a strip of elasticized material that surrounds the periphery of said enlarged opening.

10. The device as in claim 8 further comprising a support unit operatively associated with the upper end of said sheet of material wherein the support unit comprises an elongated support bar member that is adapted to be supported by the upper portion of a hunter's head.

11. The device as in claim 10; wherein, said enlarged opening divides the sheet of material into two downwardly depending panel segments.

12. The device as in claim 10; wherein, the panel segments are adapted to be joined together to encircle the hunter's head.

13. The device as in claim 12; wherein, each of the panel segments have an inwardly curved outer edge.

14. A camouflage device for disguising the silhouette of a hunter's head and shoulders wherein the device comprises a panel unit including a first panel segment and a second panel segment disposed on the opposite sides of a hunter's head wherein both panel segments are generally disposed in the same vertical plane; and means for supporting both of said panel segments in a substantially upright position on opposite sides of the hunter's head.

15. The device as in claim 14; wherein, both of said panel segments are fabricated from a single sheet of material.

16. The device as in claim 15; wherein, said panel segments have upper and lower ends that are formed integrally with one another.

17. The device as in claim 15; wherein, each of the panel segments have lower ends that are adapted to be releasably engaged with one another.

18. The device as in claim 14; wherein, said panel segments define an enlarged opening dimensioned to surround the hunter's head.

19. The device as in claim 18; wherein, said panel segments are provided with a strip of elasticized material that surrounds said enlarged opening.

20. The device as in claim 14; wherein, said means for supporting both of said panel segments comprises an elongated support bar member operatively connected to the upper end of each of said panel segments.

* * * * *